US006017255A

United States Patent [19]

Nanami

[11] Patent Number: 6,017,255

[45] Date of Patent: Jan. 25, 2000

[54] EXHAUST SYSTEM FOR ENGINE POWERING A WATERCRAFT

[75] Inventor: Masayoshi Nanami, Iwata, Japan

[73] Assignee: Yamaha Hatsudoki Kabushiki Kaisha, Iwata, Japan

[21] Appl. No.: 08/960,537

[22] Filed: Oct. 31, 1997

[30] Foreign Application Priority Data

Oct. 31, 1996 [JP] Japan ..... 8-290056

[51] Int. Cl.[7] ..... B63H 21/32

[52] U.S. Cl. ..... 440/89

[58] Field of Search ..... 440/38, 89; 114/55.5–55.58

[56] References Cited

U.S. PATENT DOCUMENTS

| | | | |
|---|---|---|---|
| 4,635,582 | 1/1987 | Nishida | 114/55.56 |
| 4,824,409 | 4/1989 | Kobayashi . | |
| 5,007,870 | 4/1991 | Okubo et al. | 114/55.5 |
| 5,096,446 | 3/1992 | Tazaki et al. | 440/89 |
| 5,524,597 | 6/1996 | Hiki et al. . | |
| 5,536,189 | 7/1996 | Mineo . | |
| 5,556,314 | 9/1996 | Fukuda et al. . | |
| 5,636,586 | 6/1997 | Suganuma . | |
| 5,676,575 | 10/1997 | Fukuka et al. . | |

*Primary Examiner*—Ed Swinehart

*Attorney, Agent, or Firm*—Knobbe, Martens, Olson & Bear LLP

[57] ABSTRACT

The present invention is an exhaust system for an engine powering a water propulsion device of a watercraft having a hull with a front end and a rear end. The water propulsion device is positioned near the rear end of the watercraft, with the engine connected to the hull and positioned generally towards the front end of the watercraft from the water propulsion device and having an output shaft arranged to drive the water propulsion device. The engine has a fuel supply system including a fuel tank positioned towards the front end of the watercraft from the engine and generally at an end of the engine opposite the water propulsion device, the engine having an exhaust system defining an exhaust flow path from the engine towards the front end of the watercraft along a first side of the fuel tank and then along a second side of the fuel tank towards the rear of said watercraft to an exhaust discharge.

9 Claims, 17 Drawing Sheets

EXHAUST SYSTEM FOR ENGINE POWERING A WATERCRAFT

FIELD OF THE INVENTION

The present invention is an exhaust system for an engine. More particularly, the invention is an exhaust system for an internal combustion engine powering a water propulsion device of a watercraft.

BACKGROUND OF THE INVENTION

Watercraft are often powered by internal combustion engines. This is especially true of the type of watercraft known as personal watercraft.

Personal watercraft have a hull which defines an engine compartment. The engine is mounted in the engine compartment and has its output shaft arranged to drive a water propulsion of the watercraft.

The engine produces exhaust products as a by-product of the combustion of fuel. It is desirable to route this exhaust from the engine to a point external to the watercraft. Generally, an exhaust system is provided for this purpose. The exhaust system normally includes at least one exhaust pipe extending from a port through the engine leading from a cylinder to a discharge point.

Many times, little attention is given the exhaust system, with the result being a detrimental affect on engine and/or watercraft performance. For example, it is generally desirable to arrange the exhaust system so that it occupies a small amount of space. In this manner, the space occupied by the engine is minimized, and the overall size of the watercraft may be minimized, lending to a light and maneuverable craft. In many instances, however, this compact arrangement results in the exhaust system having sharp turns or bends which restrict the flow of exhaust therethrough. The exhaust gas back-pressure reduces engine power, especially in two-cycle engines.

An associated problem is that when the engine has multiple cylinders, a compact exhaust system may result in the exhaust flow path corresponding to one cylinder to be different than another cylinder. When the exhaust flow paths for cylinders vary, the operating temperature of the cylinders tends to vary. The cooling and air/fuel charging needs of the cylinders then varies, complicating the design and/or operating conditions of the engine.

Also, exhaust systems for engines powering watercraft are subjected to forces which many other engines are not, especially watercraft vibration. These vibration forces have the tendency to reduce the life of the exhaust system, especially exhaust system mufflers.

An exhaust system for an engine powering a watercraft which overcomes the above-stated problems is desired.

SUMMARY OF THE INVENTION

The present invention is an exhaust system for an engine powering a watercraft. Preferably, the watercraft is of the type having a hull and a front end and a rear end. The watercraft has a water propulsion device which is preferably positioned near a rear end of the hull.

The engine is connected to the hull and has an output shaft arranged in driving relationship with the water propulsion device. The engine is mounted towards the front end of the hull from the water propulsion device. The engine is of the internal combustion type, and is provided with an exhaust system for routing exhaust products to a point external to the watercraft.

In a first embodiment of the invention, a fuel tank of a fuel system of the engine is positioned towards the front end of the hull in front of the engine. In this embodiment, the exhaust system defines an exhaust flow path extending from the engine towards the front of the hull along one side of the fuel tank, and then along a second side of the fuel tank towards a rear of the engine to a discharge point.

In a second embodiment of the invention, the engine has a cylinder bank containing at least two cylinders leaning in a direction offset from a vertical plane and an intake system provided on a side of the engine opposite the cylinder bank and cooperating therewith to define a space thereabove. In this embodiment, the engine has an exhaust system having at least two exhaust pipes leading from the engine into the space thereabove, the exhaust system further defining an exhaust flow path from each exhaust pipe in a direction towards the rear of the hull to an exhaust gas discharge.

In another embodiment, the engine has a cylinder bank containing at least two cylinders oriented in a generally vertical plane, an intake system provided on a front side of the engine facing the front end of the hull, and an exhaust passage leading from each cylinder to a rear side of the engine opposite the intake system. In this embodiment, the exhaust system defines an exhaust flow path extending towards the rear end of the hull from each passage leading through the engine to the rear side thereof.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an exhaust system for an internal combustion engine arranged to power a watercraft.

Figure 1:
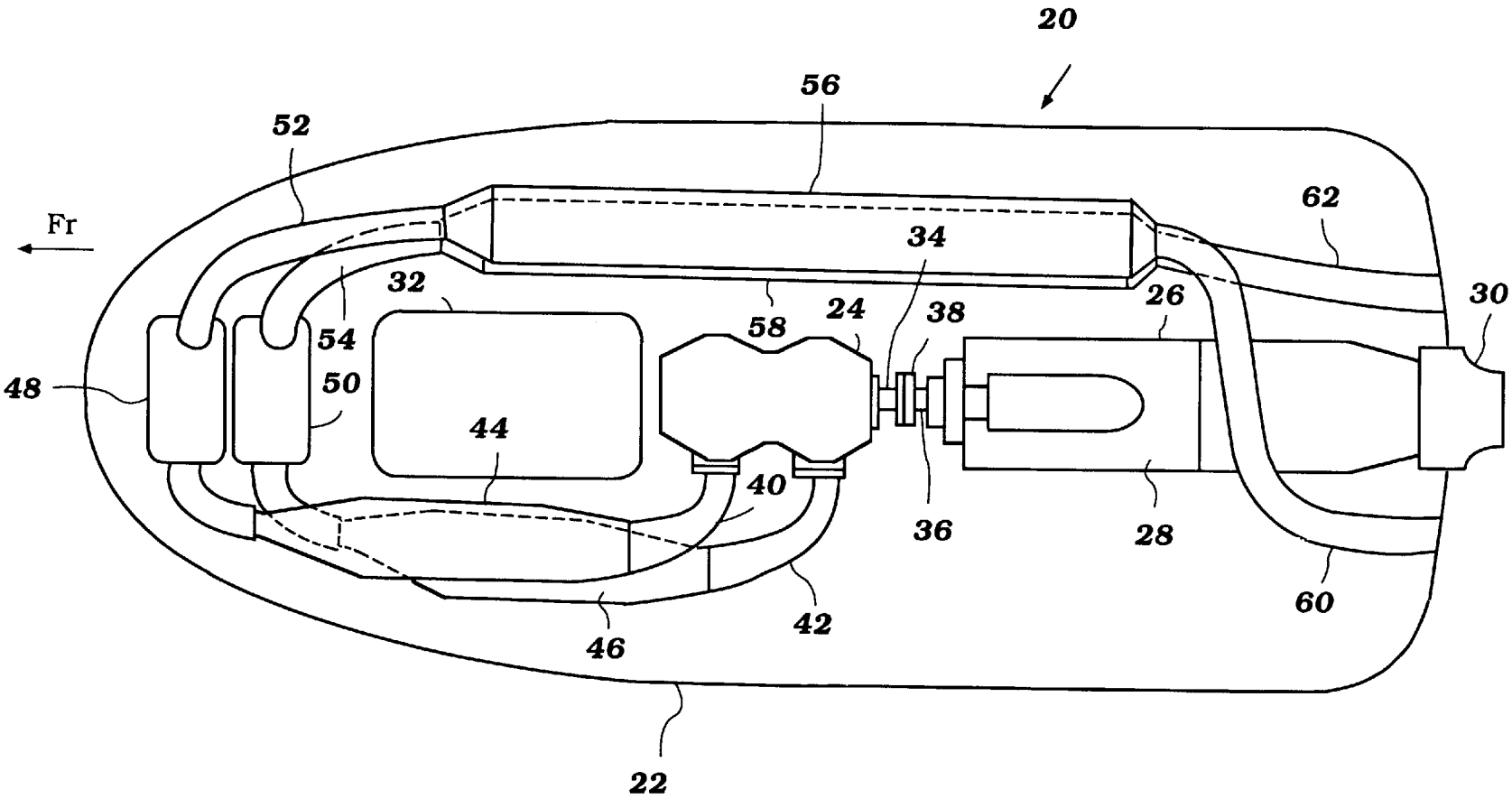
FIG. 1 is a top cross-sectional view of a watercraft powered by an engine and having an exhaust system in accordance with a first embodiment of the present invention.

A first embodiment exhaust system is illustrated in FIG. 1. As illustrated therein, a watercraft 20 includes a hull 22. An internal combustion engine 24 is connected to the hull 22. The details of the watercraft 20 are not illustrated nor described since they form no part of the present invention. As such, the watercraft 20 may be arranged in any number of manners. Preferably, the watercraft 20 is of the closed-hull type wherein the engine 24 is positioned in an engine compartment defined by the hull 22.

The watercraft 20 includes a water propulsion device 26 which is powered by the engine 24. As illustrated in FIG. 1, this water propulsion device 26 is a jet-propulsion device having a housing 28 defining a water propulsion passage through which water is drawn by an impeller (not shown) and expelled through an outlet into a steering nozzle 30 positioned at a rear end of the watercraft 20. The steering nozzle 30 is moveable, such as with a steering handle, so that the direction of the watercraft 20 may be controlled.

The engine 24 is preferably of the multi-cylinder variety. Preferably, the engine 24 has a pair of cylinders, preferably arranged in in-line fashion. As may be appreciated by those skilled in the art, the engine 24 may operate on a two-cycle or four-cycle principle, may include more than two-cylinders, and may be arranged in other than in-line fashion, such as "V" or opposed. The engine 24 may also be of the rotary type.

Though not illustrated, an air intake system is provided for delivering air to each cylinder. In addition, a fuel delivery system provides fuel to each cylinder for combustion therein. The fuel delivery system preferably includes a fuel tank 32. As illustrated, the fuel tank 32 is preferably positioned in front of the engine 24 (at that end of the engine 24 towards the front of the watercraft 20 opposite the steering nozzle 30, in the direction Fr illustrated in FIG. 1).

A piston (not shown) is positioned in each cylinder and arranged to drive a crankshaft 34 which extends from a rear end of the engine 24 (i.e. the end of the engine 24 generally opposite the fuel tank 32). The crankshaft 34 is coupled to a drive shaft 36 by a coupling 38. The drive shaft 36 extends rearward from the coupling 38 to drive the impeller or other water propulsion device.

In accordance with the present invention, there is provided an improved exhaust system which defines an exhaust flow path for routing the products of combustion from the engine 24 to a point external to the watercraft 20. Preferably, an exhaust passage (not shown) leads from each cylinder through the engine 24 generally to one side thereof (facing a side of the hull 22). A first exhaust pipe 40 is connected to the engine 24 and has a passage therethrough aligned with the passage leading from a first of the cylinders. A second exhaust pipe 42 is connected to the engine 24 and has a passage therethrough aligned with the passage leading from a second of the cylinders. The first and second exhaust pipes 40,42 preferably extend outwardly from the side of the engine 24 and then curve towards the front of the watercraft 20. The first and second exhaust pipes 40,42 are connected to first and second upstream mufflers 44,46 respectively. These mufflers 44,46 are elongate and generally extend parallel to the crankshaft 34 along one side of the fuel tank 32.

The upstream mufflers 44,46 preferably extend slightly beyond the fuel tank 32 at a front end of the watercraft 20 and are connected to first and second water locks 48,50 respectively. These water locks 48,50 may be of a variety of types known to those skilled in the art and arranged to prevent the backflow of water through the exhaust system to the engine 24. The water locks 48,50 are preferably positioned in front of the fuel tank 32 (i.e. towards the front end of the watercraft 20 and on the opposite side of the tank 32 from the engine 24).

First and second exhaust pipes or hoses 52,54 lead from the waterlocks 48,50 to first and second downstream mufflers 56,58. The downstream mufflers 56,58 are generally elongate and extend towards the rear of the watercraft 20 along a second side of the fuel tank 32 and the side of the engine 24 generally opposite the first and second exhaust pipes 40,42 extending from the engine 24.

As illustrated, a discharge exhaust pipe 60,62 extends from each downstream muffler 56,58 through the hull 22 of the watercraft 20 to a discharge external to the watercraft. As will be understood, the various parts of the exhaust system define a passage therethrough through which exhaust flows and is routed from the passage through the engine 24 corresponding to a cylinder to the discharge point external to the watercraft 20. As illustrated, one of the pipes 60 preferably discharges on one side of the steering nozzle 30, while the other pipe 62 discharges on the opposite side of the nozzle 30.

The exhaust system just described thus defines a flow path from the engine 24 towards the front end of the hull 22 along one side of the fuel tank 32, and then along a second side of the fuel tank towards the rear of the watercraft 20 to a discharge.

The exhaust system of the present invention has several distinct advantages over exhaust systems of the prior art. First, the exhaust system occupies otherwise unused space within the engine compartment, thereby opening up additional space for the engine and related components.

Second, the exhaust system is arranged so that the exhaust path from the engine 24 to discharge for the exhaust corresponding to each cylinder is nearly equal. In this manner, both cylinders have generally the same exhaust system back-pressure associated therewith, whereby the operating conditions of the cylinders are not substantially different.

Further, the exhaust system is generally symmetrically arranged around the engine 24 within the engine compartment. Most importantly, the exhaust system follows a path which allows the pathway to be generally unrestricted, i.e. there are no very sharp bends, reducing the exhaust back-pressure and improving engine operating performance.

Figure 2:
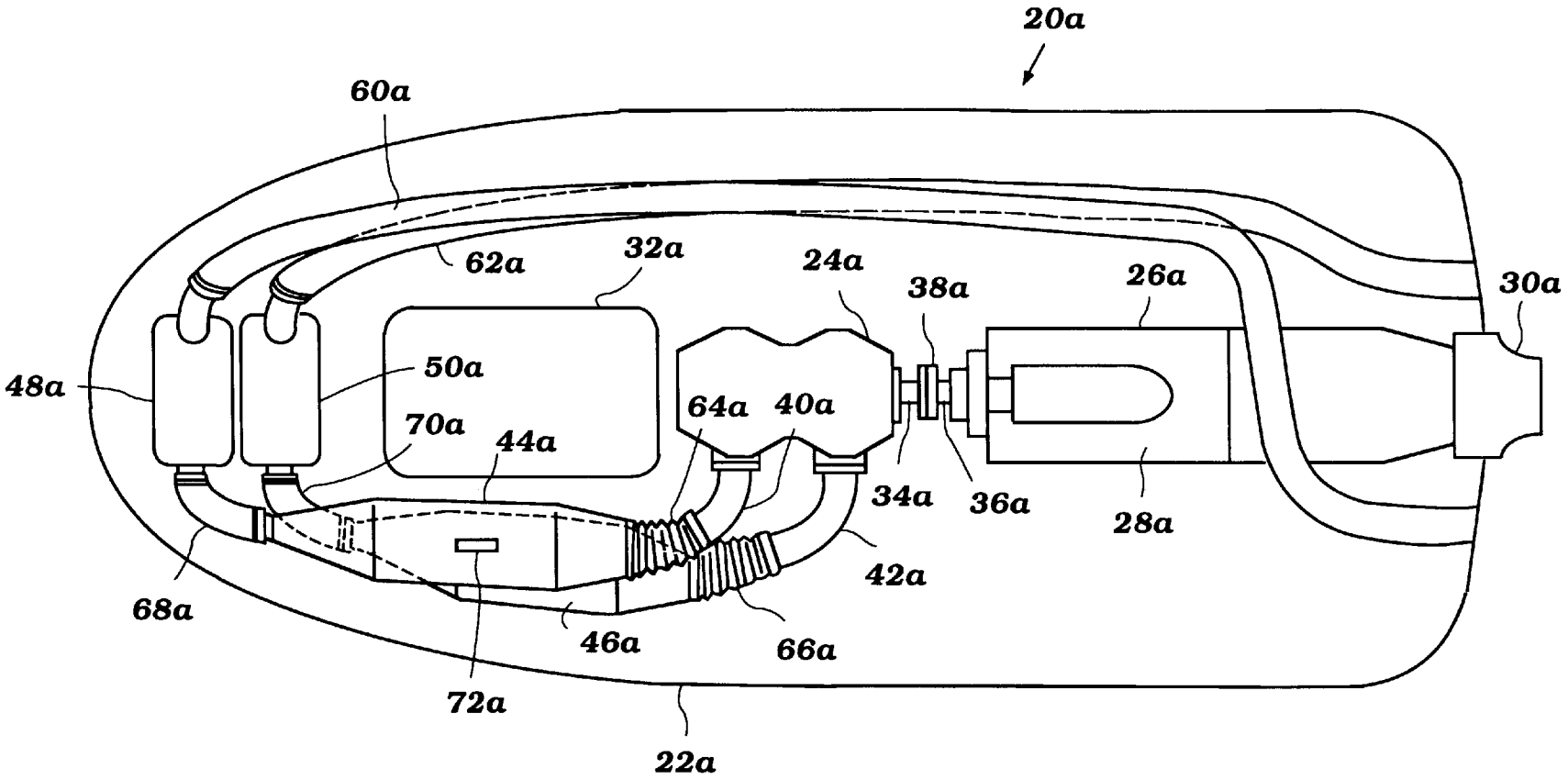
FIG. 2 is a top cross-sectional view of a watercraft powered by an engine and having an exhaust system in accordance with a second embodiment of the present invention.

FIG. 2 illustrates a watercraft 20*a* powered by an engine 24*a* and having an exhaust system in accordance with a second embodiment of the present invention. In the illustration and description of this embodiment, like reference numerals have been used with similar parts to those of the first embodiment, except that an "a" designator has been added to all reference numerals of this embodiment.

As in the prior embodiment, the engine 24*a* has a crankshaft 34*a* arranged to drive a drive shaft 36*a* through a coupling 38*a*. The drive shaft 36*a* drives an impeller or similar member of a water propulsion device 28*a*.

The exhaust system of this embodiment of the present invention includes a first exhaust pipe 40*a* connected to the engine 24*a* and leading from the exhaust passage leading from a first cylinder, and a second exhaust pipe 42*a* connected to the engine 24*a* and leading from the exhaust passage leading from a second cylinder. These exhaust pipes 40*a*,42*a* curve outwardly and forwardly from the engine 24*a* towards first and second mufflers 44*a*,46*a*.

As illustrated, a flexible coupling 64*a* is provided between the first exhaust pipe 40*a* and corresponding muffler 44*a*. A similar coupling 66*a* is provided between the second exhaust pipe 42*a* and corresponding muffler 46*a*. These couplings 64*a*,66*a*, may comprise resilient hoses, metal conduits or the like.

As in the first embodiment, the mufflers 46*a* extend towards a front end of the engine 24*a* along a fuel tank 32*a*. A pair of water locks 48*a*,50*a* are positioned near the front end of the watercraft 20*a* in front of the fuel tank 32*a*. An exhaust pipe or hose 68*a* extends from a first of the mufflers 44*a* to a first water lock 48*a*, while a similar exhaust pipe or hose 70*a* extends from the other muffler 46*a* to the other water lock 50*a*.

A first discharge exhaust pipe 60*a* extends from a first of the water locks 48*a* around the other side of the fuel tank 32*a* and along the side of the engine 24*a* opposite the mufflers 44*a*,46*a* and through the hull 22*a* at a rear end of the watercraft 20*a*. A second discharge exhaust pipe 62*a* extends from a second of the water locks 50*a* around the same side of the fuel tank 32*a* and long the side of the engine 24*a* opposite the mufflers 44*a*,46*a* and through the hull 22*a* at the rear end of the watercraft 20*a*.

The exhaust flow path of the exhaust system of this embodiment of the invention is similar to the first, flowing from the engine towards the front of the watercraft along one side of the fuel tank, and then along another side of the fuel tank towards the rear of the engine.

This exhaust system generally has the advantages of the exhaust system of the first embodiment and has the added advantage that the transmission of engine vibration to the mufflers 44*a*,46*a* is reduced. As illustrated in FIG. 1, in the first embodiment the exhaust pipes are rigidly connected to the upstream mufflers and support them. In this embodiment, the flexible couplings 64*a*,66*a* serve to isolate the mufflers 44*a*,46*a* from engine vibration transmitted to the exhaust pipes 40*a*,42*a* which are coupled to the engine 24*a*.

Figure 3:
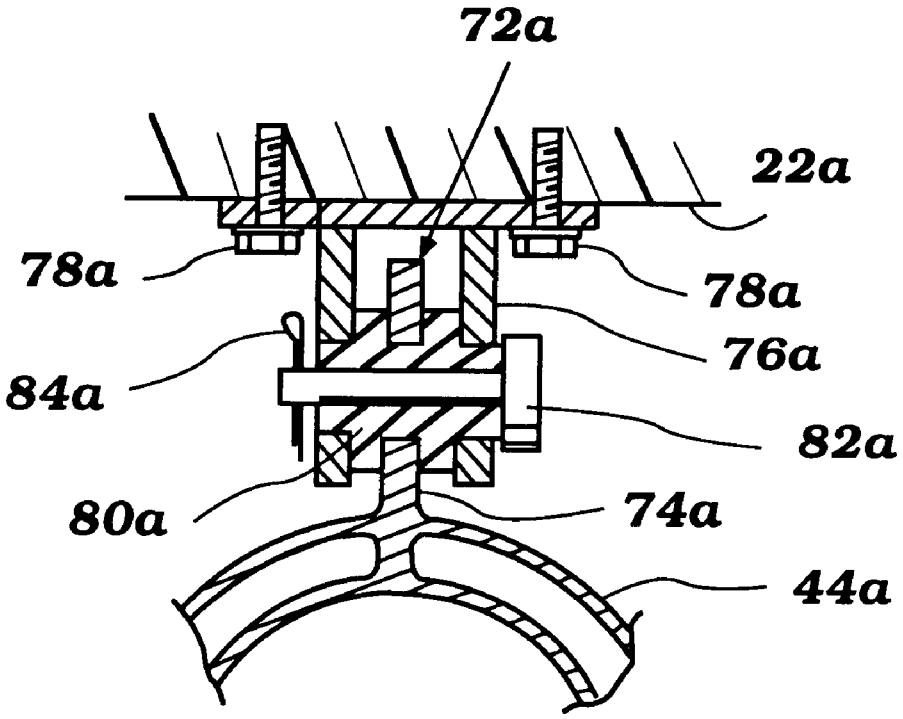
FIG. 3 is an enlarged cross-sectional view of a mounting for a muffler of the second embodiment exhaust system illustrated in FIG. 2.

Since the exhaust pipes 40*a*,42*a* do not support the mufflers 44*a*,46*a*, a mounting 72*a* is provided for removably coupling the mufflers 44*a*,46*a* to the watercraft 20*a*. Referring primarily to FIG. 3, a mounting flange 74*a* extends generally vertically upward from the muffler 44*a*. A bracket 76*a* is connected to the hull 22*a* of the watercraft 20*a*. The bracket 76*a* is preferably connected to the hull 22*a* via a pair of bolts 78*a* or similar fasteners. The bracket 76*a* depends downwardly from the hull 22*a* and has a pair of spaced legs.

A pin 82*a* extends through a passage in each leg of the bracket 76*a* and a passage through the flange 74*a* when positioned between the legs of the bracket 76*a*. A resilient elastomer 80*a* is positioned about the pin 82 and separate the pin 82*a* from the bracket 76*a* and flange 74*a*, and the flange 74*a* from the legs of the bracket 76*a*. A cotter pin 84*a* is preferably provided for maintaining the pin 82*a* in position.

A similar mounting is preferably provided for the other muffler 46*a*. The mounting 72*a* has the advantage that the muffler 44*a* is removably connected to the watercraft 20*a* and yet is supported thereby. In addition, the mounting 72*a* is arranged to prevent the transmission of watercraft 20*a* vibration to the muffler 44*a* serving to increase the life of the muffler.

FIGS. 4–7 illustrate a watercraft 20*b* powered by an engine 24*b* and having an exhaust system in accordance with a third embodiment of the present invention. In the illustration and description of this embodiment, like reference numerals have been used with similar parts to those of the prior embodiments, except that a "b" designator has been added to all reference numerals of this embodiment.

As in the prior embodiments, the engine 24*b* is arranged to drive an impeller or similar device of a water propulsion unit 26*b* of the watercraft 20*b*. In this embodiment, the housing 28*b* of the water propulsion unit 26*b* extends beyond the hull 22*b* at the rear end of the watercraft 20*b*.

Preferably, the portion of the housing 28*b* extending beyond the hull 22*b* is supported by a support member 86*b*. As illustrated, the support member 86*b* generally surrounds the housing 28*b* and preferably has a curved outer surface corresponding to that portion which faces downwardly into the water. First and second straps 88*b* provide lateral support to the support member 86*b*, extending from a connection at one end to the hull 22*b* to the member 86*b*.

Figure 4:
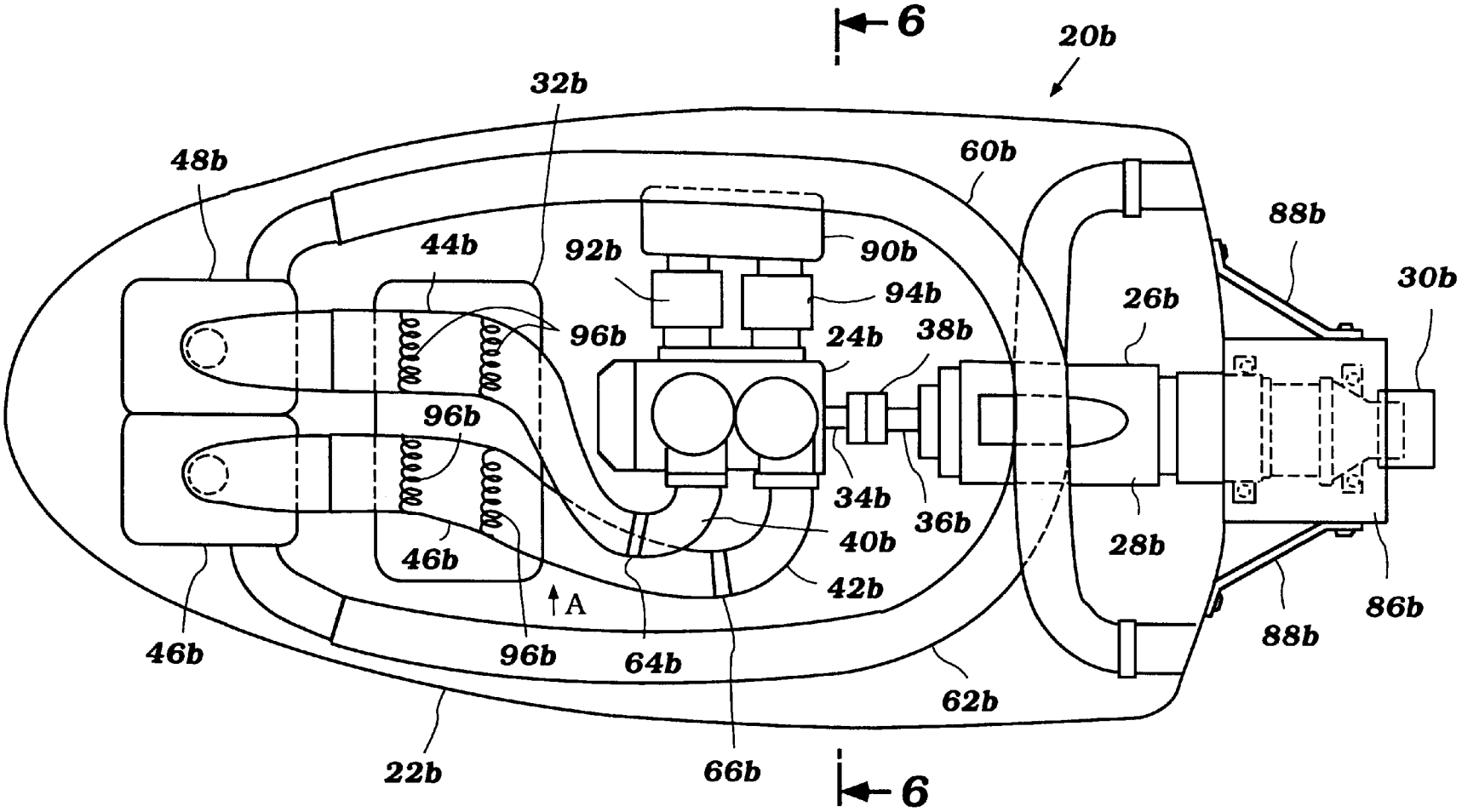
FIG. 4 is a top cross-sectional view of a watercraft powered by an engine and having an exhaust system in accordance with a third embodiment of the present invention.
Figure 6:
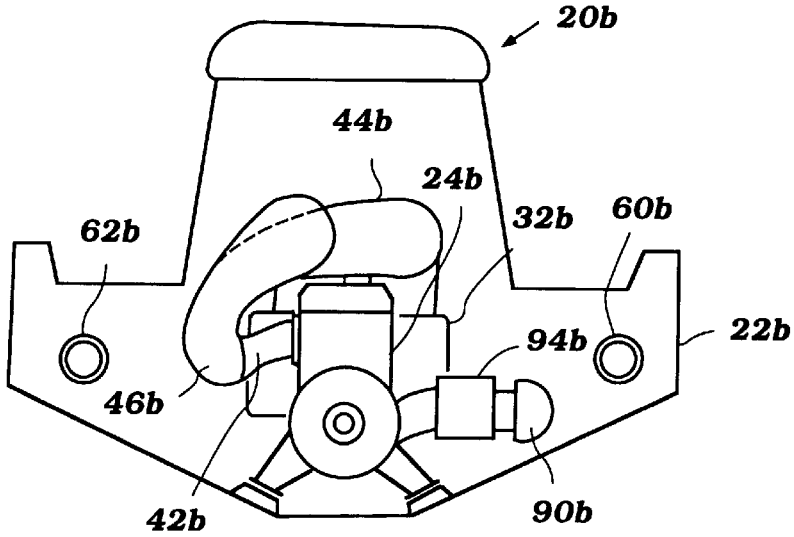
FIG. 6 is a cross-sectional view of the watercraft and exhaust system illustrated in FIG. 4 and taken along line 6—6 therein.
Figure 7:
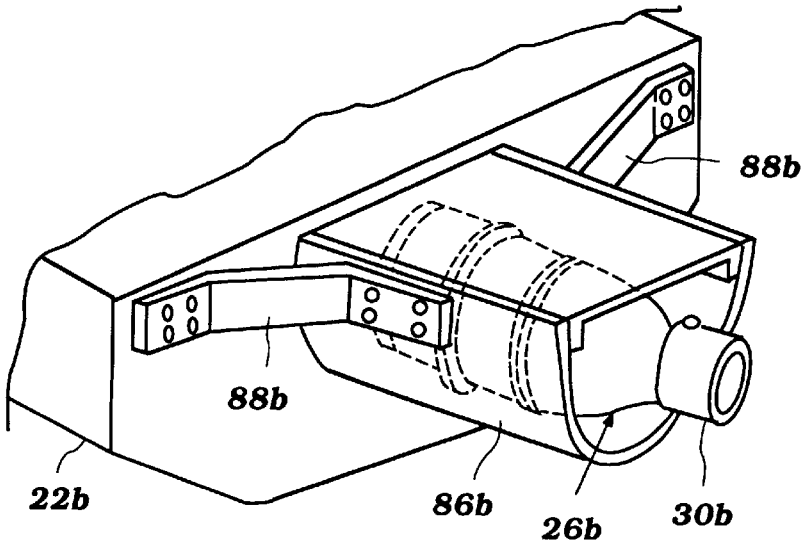
FIG. 7 is an enlarged perspective view of a rear portion of the watercraft illustrated in FIG. 4.

FIGS. 4 and 6 illustrate a part of the air intake system and fuel delivery system of the engine 24*b*. Air is preferably drawn from within the engine compartment through an intake silencer 90*b*. Air then passes through first and second intake passages (one intake passage corresponding to each cylinder of the engine) leading from the silencer 90*b* to first and second carburetors 92*b*,94*b*. Each carburetor 92*b*,94*b* is arranged to deliver fuel into air passing therethrough. The resultant fuel and air mixture is then delivered to a corresponding cylinder for combustion.

Figure 5:
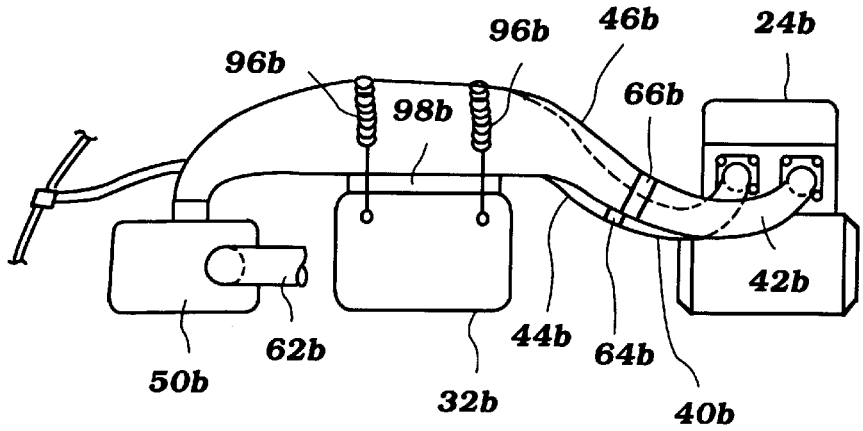
FIG. 5 is a side view of the exhaust system illustrated in FIG. 4 taken in the direction of arrow A therein.

The exhaust system of this embodiment of the invention is best illustrated in FIGS. 4–6. As illustrated, first and second exhaust pipes 40*b*,42*b* again extend outwardly from a side of the engine 24*b* and curve forwardly towards first and second mufflers 44*b*,46*b*. In this embodiment, resilient couplings 64*b*,66*b* are preferably provided between the pipes 40*b*,42*b* and their respective mufflers 44*b*,46*b*.

Preferably, the mufflers 44*b*,46*b* extend generally in front of the engine 24*b* generally above the fuel tank 32*b*. The mufflers 44*b*,46*b* each lead to a water lock 48*b*,50*b* positioned at the front end of the watercraft 20*b* in front of the fuel tank 32*b*.

A discharge exhaust pipe 60*b*,62*b* extends from the water lock 48*b*,50*b* through the housing 28*b* of the water propulsion device 26*b* for discharge into the water therein. In this manner the exhaust is expelled out the rear end of the watercraft with water flowing through the housing 28*b*.

In this embodiment, like the last, the exhaust pipes 40*b*,42*b* do not rigidly support the mufflers 44*b*,46*b*. Support for the mufflers 44*b*,46*b* is preferably provided by multiple springs 96*b* connected to a mounting part 98*b* provided on the fuel tank 32*b*. This spring mounting 96*b* provides resilient support for the mufflers 44*b*,46*b*.

The water propulsion unit 26*b* as arranged in this embodiment has the benefit that the water intake is positioned nearer the rear of the watercraft than in other embodiments. Thus, when the watercraft 20*b* is in its planing position, the possibility of air being introduced into the water propulsion unit is reduced. This increases the efficiency of the water propulsion device, allowing the watercraft to achieve a higher speed. This propulsion arrangement also results in improve turning ability and handling since the thrust point is moved rearward, and because the mounting 86*b* is curved on its bottom, the resistance is reduced.

Because the propulsion unit 26*b* is moved rearward, the exhaust discharge pipes 60*b*,62*b* can advantageously discharge into the housing 28*b* (instead of through the rear of the hull 22*b* ) without being tightly curved and thus restricting the exhaust flow. In addition, the exhaust system is again isolated from engine and watercraft vibration.

In the first two embodiments, the first and second sides of the fuel tank along which the exhaust path extends are opposing sides of the tank which face the sides of the watercraft or hull. In this embodiment, however, the first side of the fuel tank 32*b* comprises a top side of the fuel tank, while the second side comprises the sides facing side of the hull or watercraft.

Figure 8:
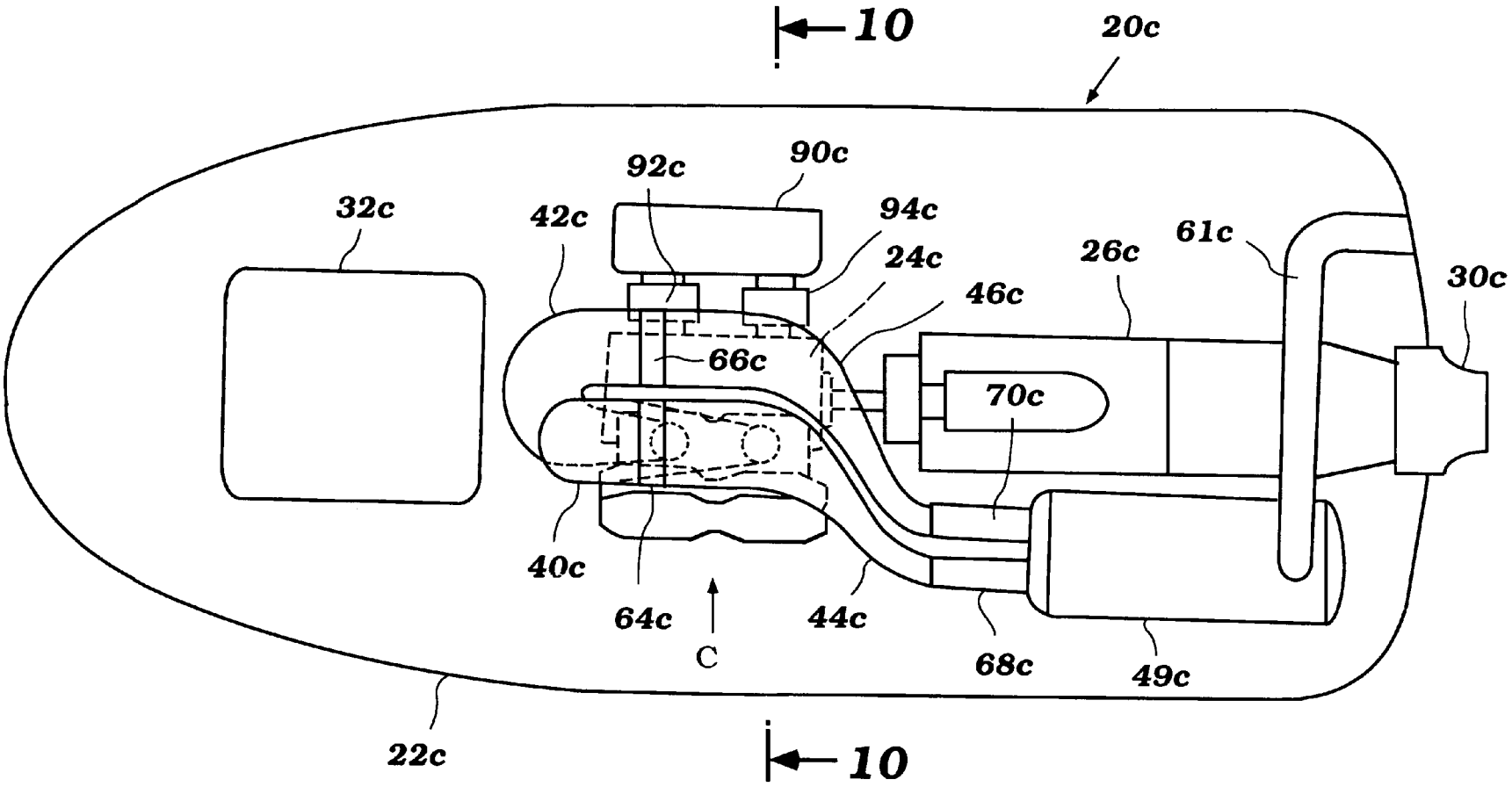
FIG. 8 is a top cross-sectional view of a watercraft powered by an engine and having an exhaust system in accordance with a fourth embodiment of the present invention.
Figure 9:
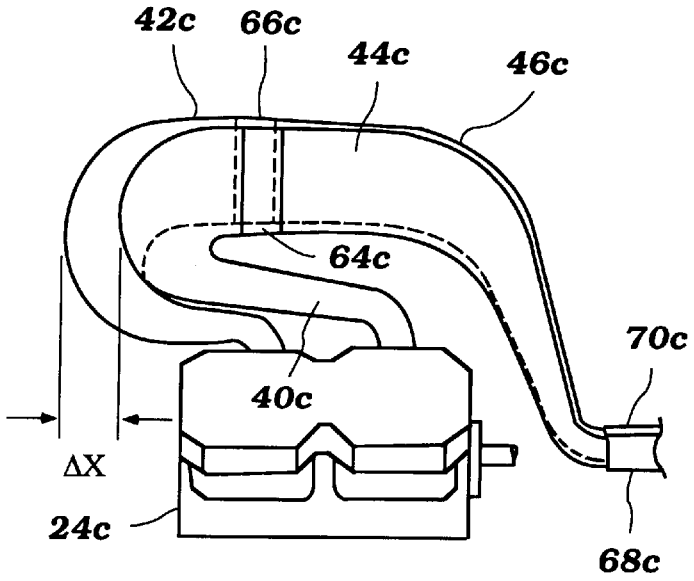
FIG. 9 is a side view of the exhaust system illustrated in FIG. 8 and taken in the direction of arrow C therein.
Figure 10:
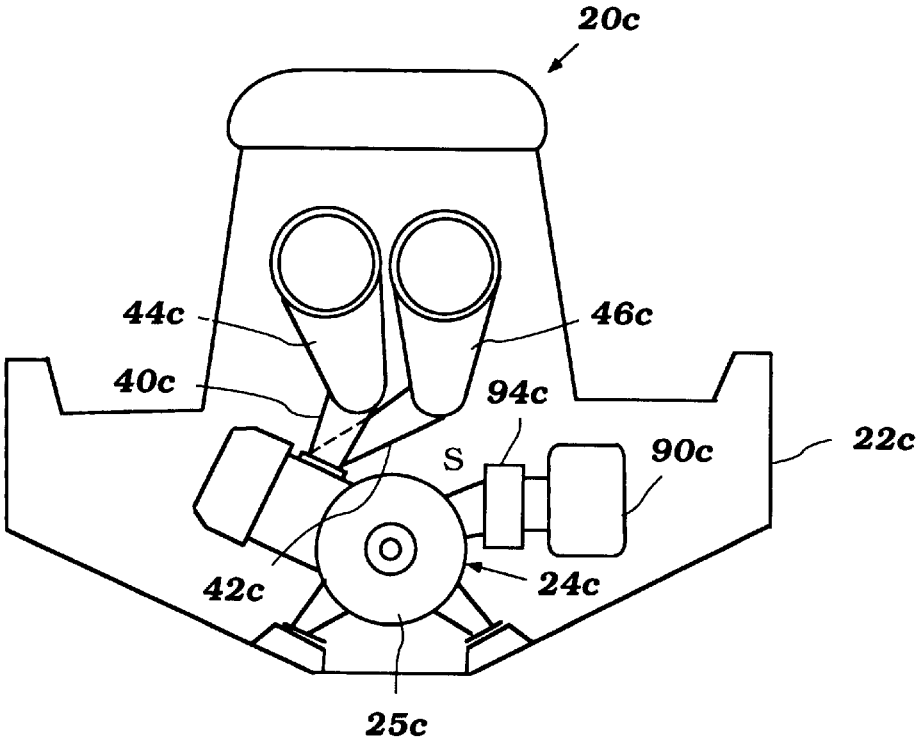
FIG. 10 is a cross-sectional view of the watercraft and exhaust system illustrated in FIG. 8 taken in the direction of line 10—10 therein.

FIGS. 8–10 illustrate a watercraft 20*c* powered by an engine 24*c* and having an exhaust system in accordance with a fourth embodiment of the present invention. In the illustration and description of this embodiment, like reference numerals have been used with similar parts to those of the prior embodiments, except that a "c" designator has been added to all reference numerals of this embodiment.

As in the prior embodiments, the engine 24*c* preferably has a pair of cylinders having pistons which drive a crankshaft which drives a water propulsion device 26*c* having a discharge in a steering nozzle 30*c* positioned at the rear of the watercraft 20*c*. The engine 24*c* is preferably operates on a two-cycle principle and has its cylinders leaning in a direction slightly above horizontal.

As best illustrated in FIG. 10, the air intake is preferably arranged so that the silencer 90*c* and carburetors 92*c*,94*c* are positioned along one side of the engine 24*c*. The air and fuel charge created thereby is supplied to a crankcase 25*c* portion of the engine 24*c* (the engine operating on a two-cycle crankcase compression cycle and being appropriately arranged, as well known to those of skill in the art), and connected to the crankcase 25*c* generally opposite the side thereof to which the cylinders extend. In this arrangement, a valley or open space S is created above the engine 24*c* between that portion defining the cylinders and that the intake system.

The exhaust system includes a first exhaust pipe 40*c* extending from the engine 24*c* and having a passage therethrough aligned with an exhaust passage leading from a first of the cylinders. A second exhaust pipe 42*c* extends from the engine 24*c* and has a passage aligned with an exhaust passage leading from a second of the cylinders.

As best illustrated in FIGS. 9 and 10, the exhaust pipes 40*c*,42*c* preferably extend generally vertically upward from the top of the engine 24*c* into the space S. After extending up from the engine 24*c*, the exhaust pipes 40*c*,42*c* extend forward towards the front of the engine before bending up and rearwardly towards a muffler 44*c*,46*c*.

The exhaust pipes 40*c*,42*c* are preferably connected to a respective muffler 44*c*,46*c* via a resilient coupling, such as a rubber hose 64*c*,66*c*. The mufflers 44*c*,46*c* extend generally rearward through the space S above the engine 24*c* before curving downward to a single water lock 49*c*. Preferably, each muffler 44*c*,46*c* is connected to the water lock 49*c* via a resilient coupling such as a rubber hose 68*c*,70*c*. A single discharge exhaust pipe 61*c* leads from the water lock 49*c* through the hull 22*c* at the rear of the watercraft 22*c*.

The exhaust system of this embodiment has the similar advantages to those described above in conjunction with the other embodiments. First, because of the layout of the engine 24*c* resulting in the space S, the exhaust system may have a compact arrangement in conjunction with the engine, minimizing the engine compartment size and lending to a smaller watercraft size.

Another advantage of the invention is that the exhaust path corresponding to each cylinder is nearly equal. In this regard, and referring to FIG. 9, the second exhaust pipe 42*c* preferably extends forwardly of the first exhaust pipe 40*c* by an amount $\Delta X$ so that the exhaust paths are of the same length (this compensates for the fact that the exhaust ports are arranged so that one is forward of the other and thus the exhaust pipes 40*c*,42*c* are connected to the engine at different locations therealong).

The resilient coupling of the exhaust pipes 40*c*,42*c* to the mufflers 44*c*,46*c* and the resilient coupling of the mufflers 44*c*,46*c* to the water lock 49*c* advantageously reduces the transmission of engine and watercraft vibration to the mufflers 44*c*,46*c* serving to increase the life thereof.

Figure 11:
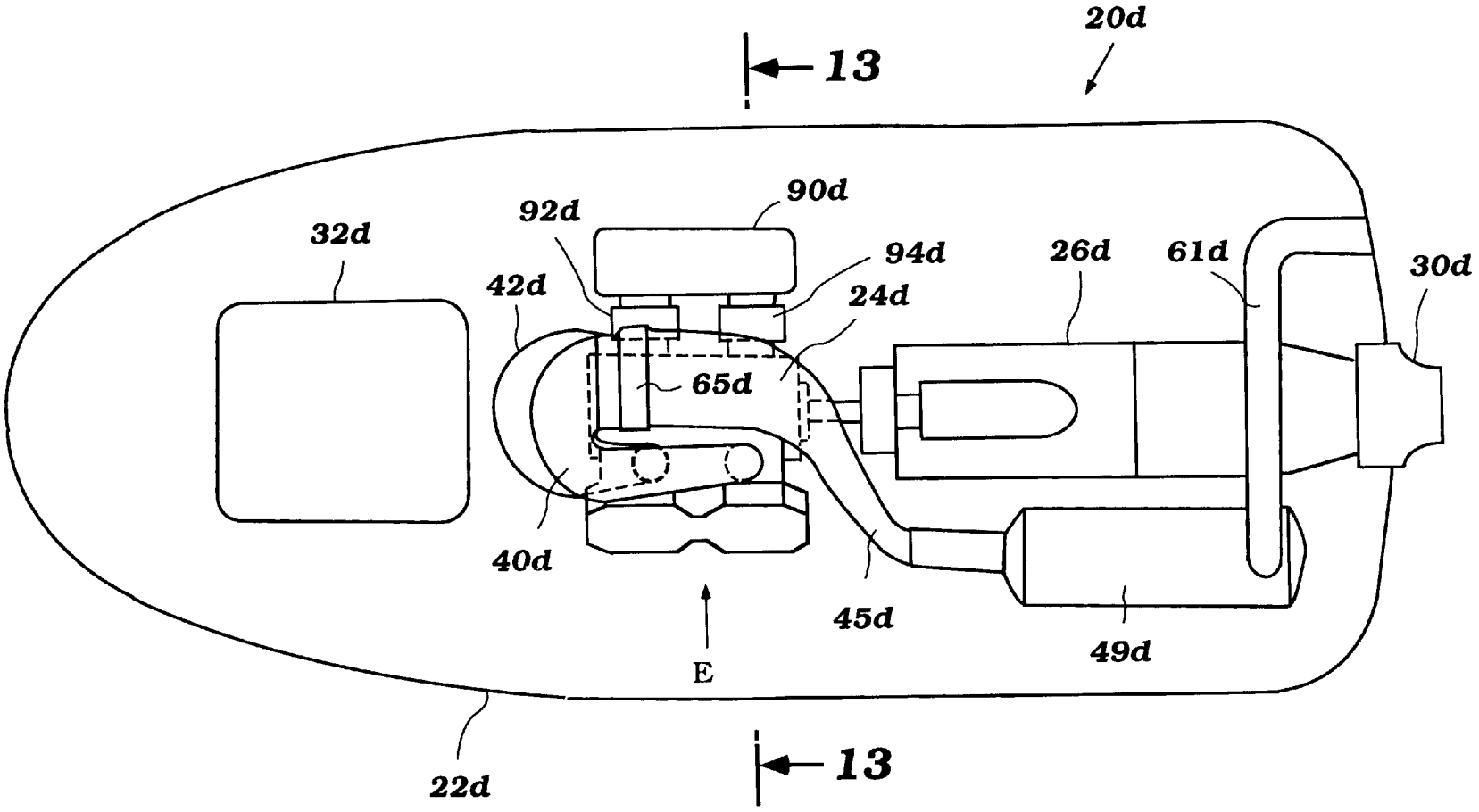
FIG. 11 is a top cross-sectional view of a watercraft powered by an engine and having an exhaust system in accordance with a fifth embodiment of the present invention.
Figure 12:
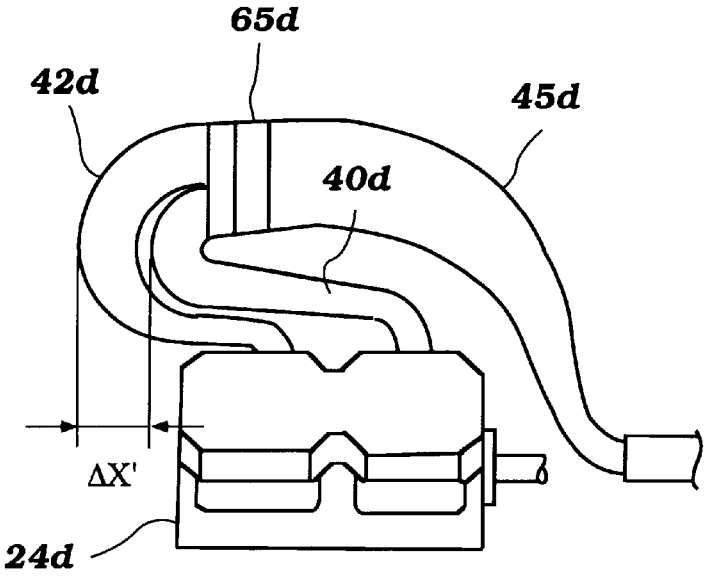
FIG. 12 is a side view of the exhaust system illustrated in FIG. 11 and taken in the direction of arrow E therein.
Figure 13:
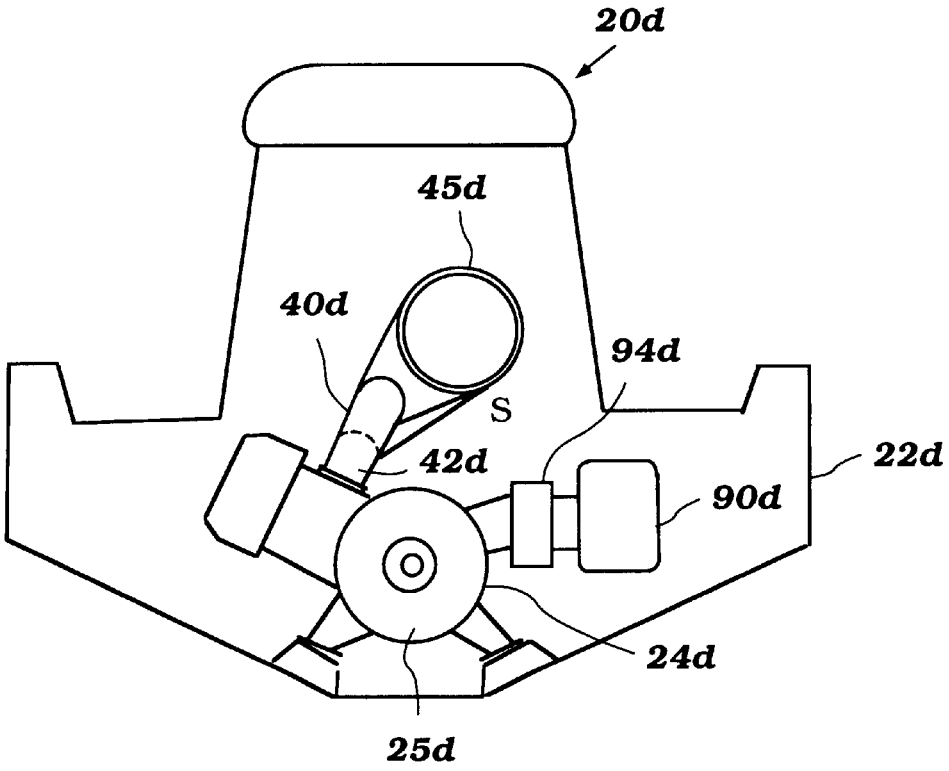
FIG. 13 is a cross-sectional view of the watercraft and exhaust system illustrated in FIG. 12 taken in the direction of line 13—13 therein.

FIGS. 11–13 illustrate a watercraft 20*d* powered by an engine 24*d* and having an exhaust system in accordance with a fifth embodiment of the present invention. In the illustration and description of this embodiment, like reference numerals have been used with similar parts to those of the prior embodiments, except that a "d" designator has been added to all reference numerals of this embodiment.

In this embodiment, the engine 24*d* is arranged in similar fashion to that illustrated in FIGS. 8–10 where a space S is defined above the engine 24*d* between the air intake and that portion of the engine defining the cylinders.

The exhaust system again includes an exhaust pipe 40*d*, 42*d* extending from the exhaust passage corresponding to each cylinder. The exhaust pipes 40*d*,42*d* extend up and then towards the front end of the engine before bending up and towards the rear end of the engine to a single muffler or expansion pipe 45*d*. The muffler 45*d* extends through the space S to the rear of the engine 24*d* before bending downwardly to a single water lock 49*d*. A single exhaust discharge pipe 61*d* preferably extends from the water lock 49*d* through the hull 22*d* at the rear of the watercraft 20*d* for routing exhaust gases into the water.

Preferably, the exhaust pipes 40*d*,42*d* are connected to the muffler 45*d* via a resilient coupling 65*d*, such as a rubber hose.

The exhaust system of this embodiment has generally the same advantages as those of the embodiment illustrated in FIGS. 8–10. Once again, the exhaust path from each cylinder to discharge is nearly equal. In this regard, the exhaust pipe 42*d* corresponding to the forward most cylinder (and thus forward most exhaust passage through the engine) extends towards the front end of the engine 24*d* by a distance $\Delta X'$ greater than the distance that the other exhaust pipe 40*d* extends towards the front end of the engine. In this manner, the exhaust pipes 40*d*,42*d* each define an exhaust path which is of the same length leading to the common exhaust passage thereon to the discharge.

Figure 14:
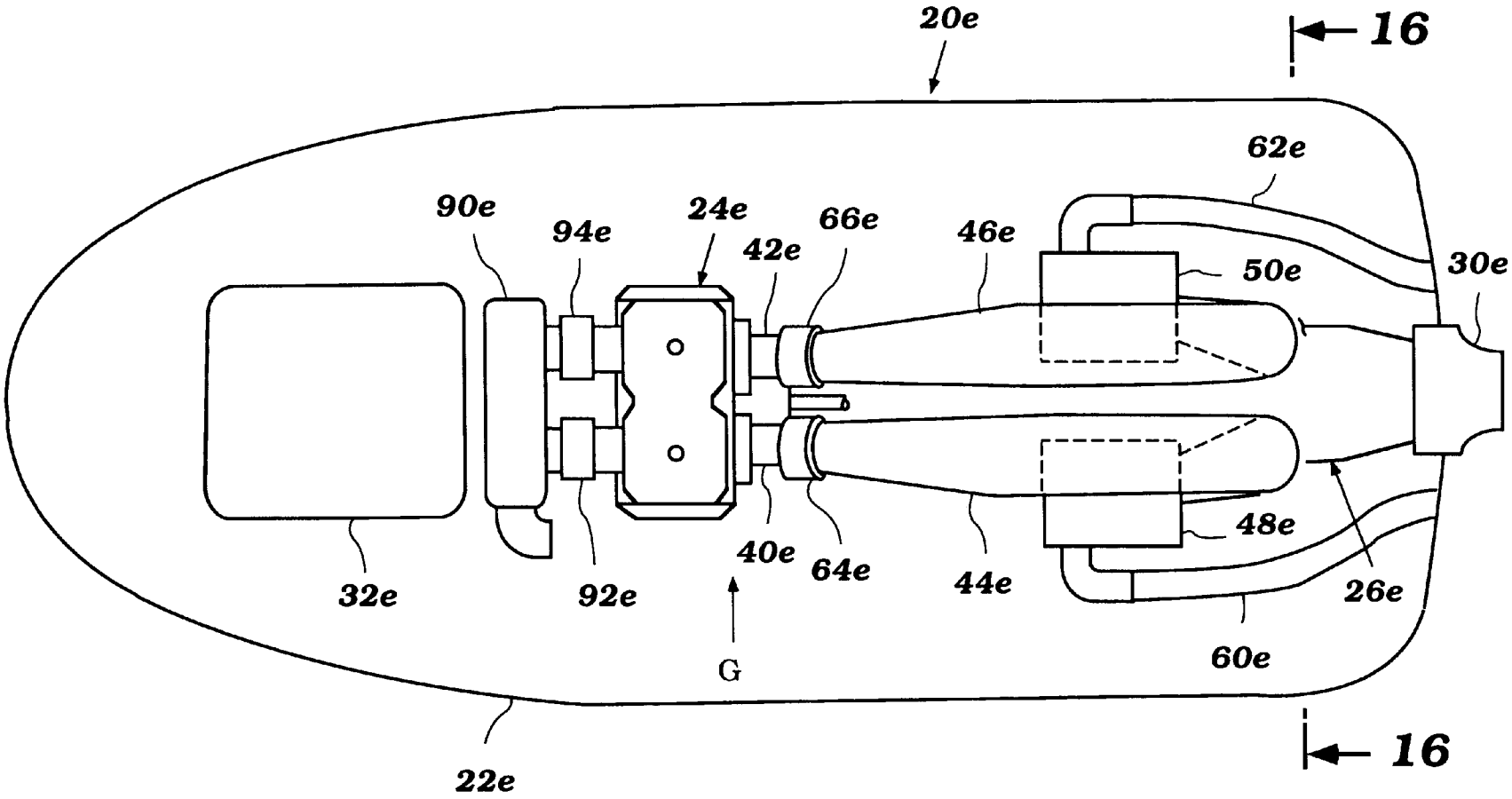
FIG. 14 is a top cross-sectional view of a watercraft powered by an engine and having an exhaust system in accordance with a sixth embodiment of the present invention.
Figure 15:
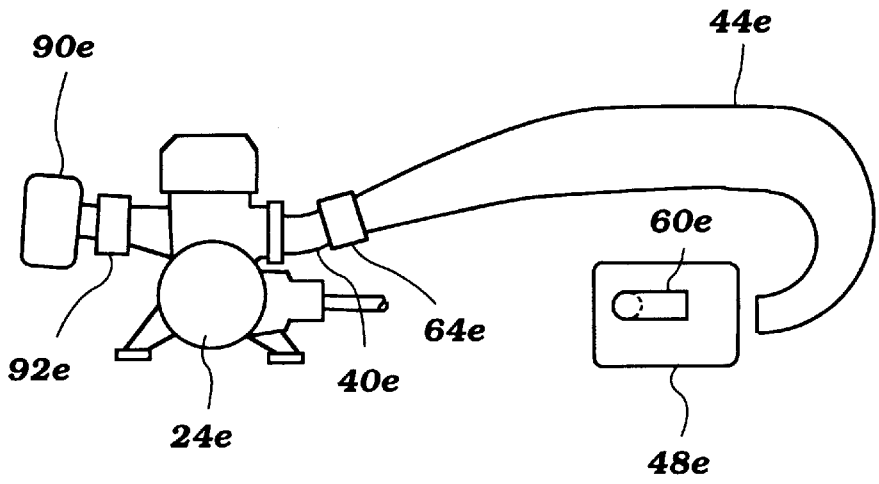
FIG. 15 is a side view of the exhaust system illustrated in FIG. 14 and taken in the direction of arrow G therein.
Figure 16:
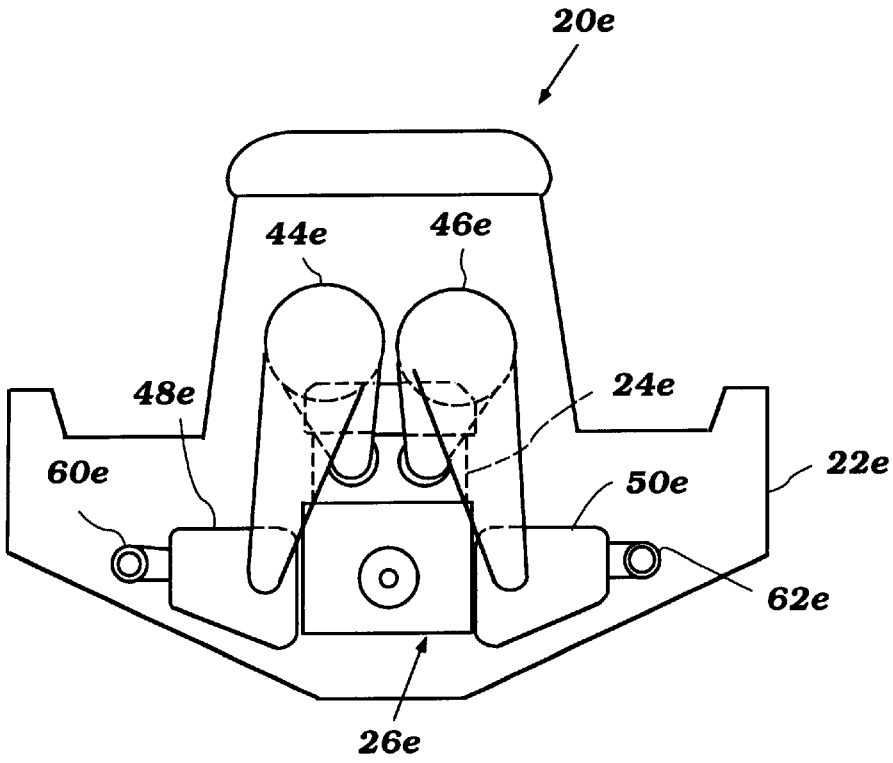
FIG. 16 is a cross-sectional view of the watercraft and exhaust system illustrated in FIG. 14 taken in the direction of line 16—16 therein.

FIGS. 14–16 illustrate a watercraft 20*e* powered by an engine 24*e* and having an exhaust system in accordance with a sixth embodiment of the present invention. In the illustration and description of this embodiment, like reference numerals have been used with similar parts to those of the prior embodiments, except that an "e" designator has been added to all reference numerals of this embodiment.

In accordance with this embodiment, the engine 24*e* is arranged so that its pair of cylinders are aligned along an axis extending transverse to the watercraft 20*e* (i.e. parallel to a line extending through the sides of the watercraft or perpendicular to a line extending through the front and rear of the watercraft). The pistons of each cylinder are arranged to drive a crankshaft which is also transversely extending, but which is arranged to drive a drive shaft which extends out engine towards the rear of the watercraft 24*e* to drive the water propulsion device.

In this arrangement, the intake, including the silencer 90*e* and carburetors 92*e*,94*e* are preferably positioned at a front end of the engine 24*e* just behind a fuel tank 32*e*.

The exhaust passage leading from each cylinder terminate at a rear end of the engine 24*e*. The exhaust system includes a first exhaust pipe 40*e* connected to the engine 24*e* and having a passage therethrough aligned with the exhaust passage corresponding to one of the cylinders. A second exhaust pipe 42*e* is similarly provided for the exhaust passage corresponding to the other cylinder. The exhaust pipes 40*e*,42*e* extend rearwardly from the engine 24*e* to a corresponding muffler 44*e*,46*e*. Preferably, each exhaust pipe 40*e*,42*e* is coupled to its respective muffler 44*e*,46*e* with a flexible coupling 64*e*,66*e*, such as a rubber hose.

The mufflers 44*e*,46*e* extend in a generally straight line towards the rear of the engine 24*e* to a respective water lock 48*e*,50*e*. As illustrated, each muffler 44*e*,46*e* connects to a rear portion of its respective water lock 48*e*,50*e*.

An exhaust discharge pipe 60*e*,62*e* extends from the water lock 60*e*,62*e* through the hull 22*e* of the watercraft 20*e* at its rear end where the exhaust gas is discharged into the water. As illustrated, these discharge pipes 60*e*,62*e* extend from an outer side (i.e. a side facing towards the closest outer side of the watercraft hull) of its respective water lock 60*e*,62*e*.

The exhaust system of this embodiment of the invention has advantages similar to those of the prior embodiments, including the fact that the exhaust flow path is generally straight and unrestricted. In addition, the exhaust flow path corresponding to each cylinder is generally of the same length. Engine vibration is effectively isolated from the mufflers 44*e*,46*e* by the resilient or flexible couplings 64*e*, 66*e*.

Figure 17:
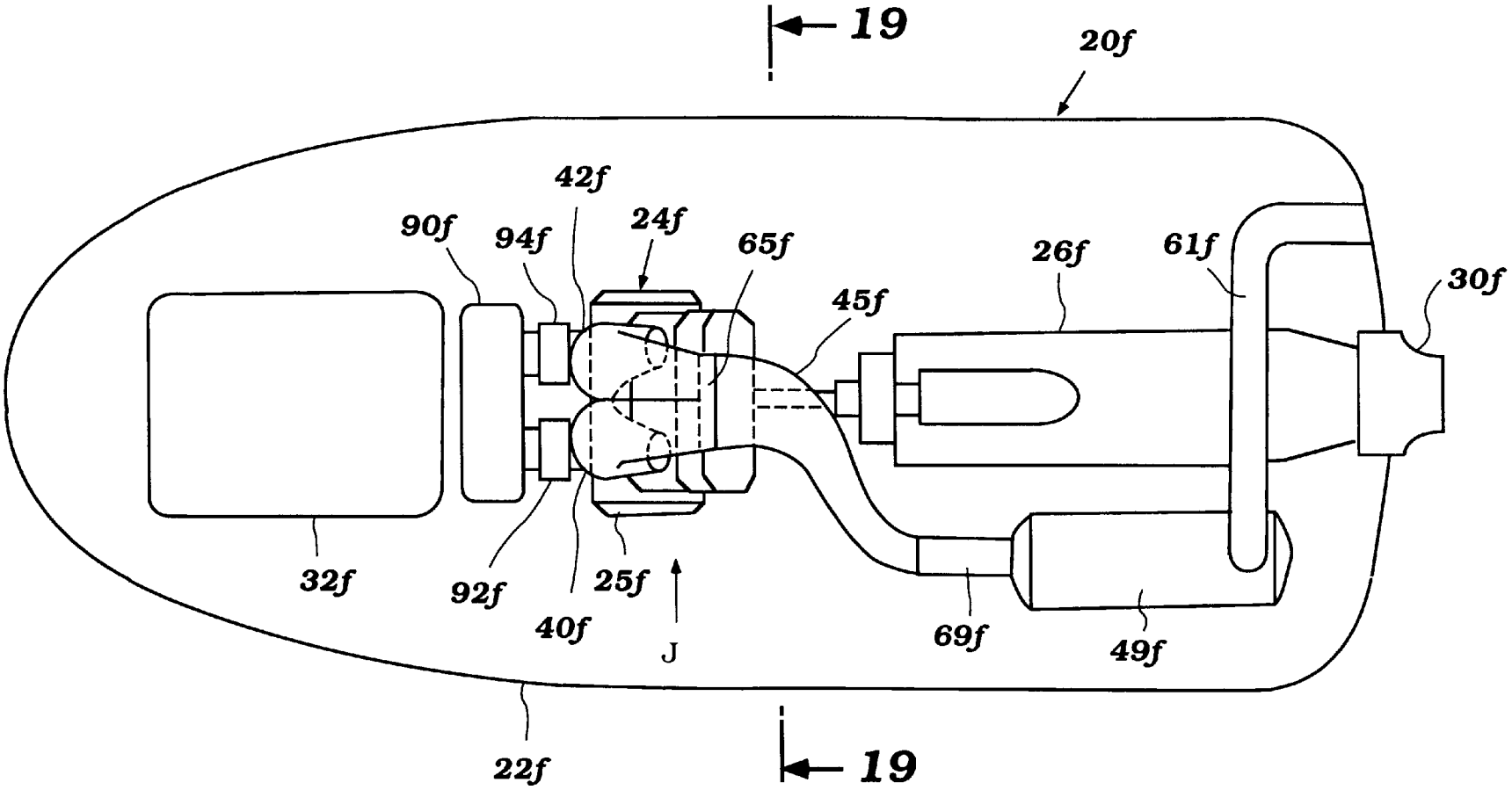
FIG. 17 is a top cross-sectional view of a watercraft powered by an engine and having an exhaust system in accordance with a seventh embodiment of the present invention.
Figure 18:
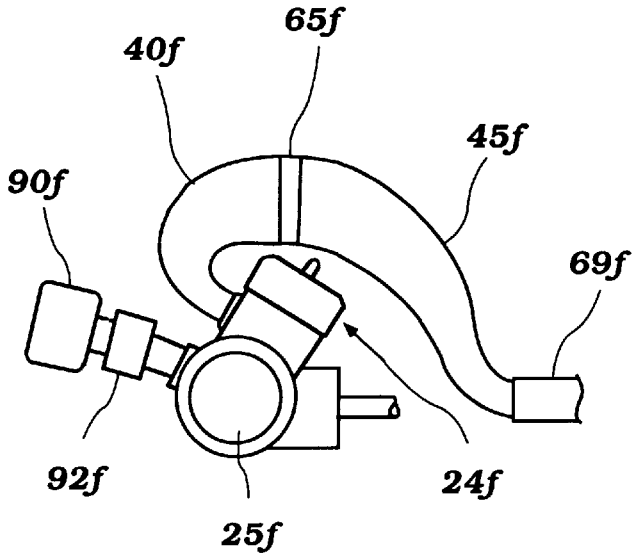
FIG. 18 is a side view of the exhaust system illustrated in FIG. 17 and taken in the direction of arrow J therein.
Figure 19:
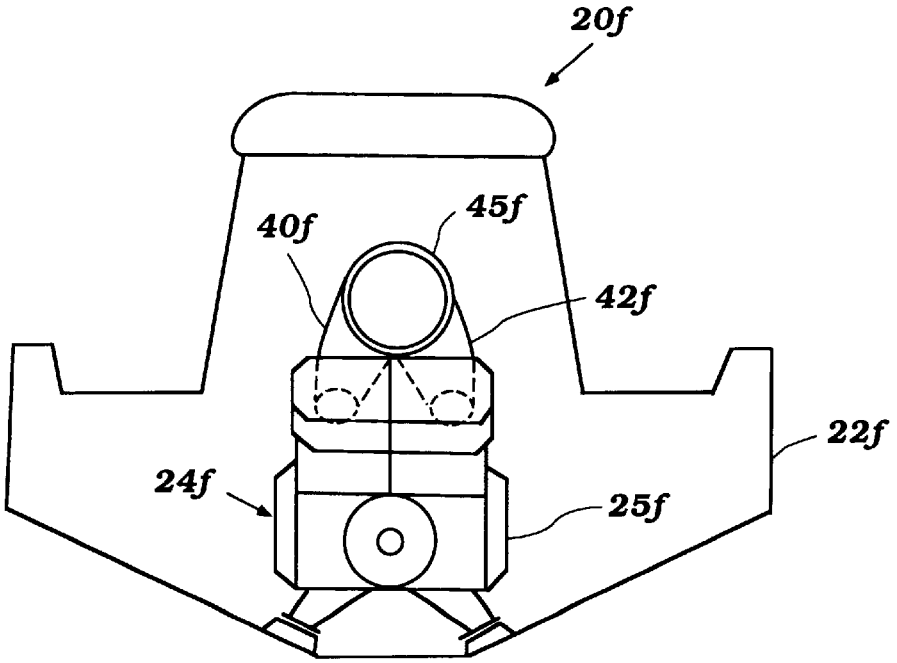
FIG. 19 is a cross-sectional view of the watercraft and exhaust system illustrated in FIG. 17 taken in the direction of line 19—19 therein.

FIGS. 17–19 illustrate a watercraft 20*f* powered by an engine 24*f* and having an exhaust system in accordance with a seventh embodiment of the present invention. In the illustration and description of this embodiment, like reference numerals have been used with similar parts to those of the prior embodiments, except that an "f" designator has been added to all reference numerals of this embodiment.

This embodiment is similar to that illustrated in FIGS. 14–16. In this embodiment, however, the cylinders of the engine 24*f* are tilted towards a rear of the watercraft 20*f* from a crankcase 25*f*. In this arrangement, the air intake is again positioned at a front of the engine 24*f*. In this orientation, a space S' is defined above the engine 24*f* between that portion defining the cylinders and the air intake system.

The exhaust system again includes first and second exhaust pipes 40*f*,42*f* corresponding to the exhaust passages of the pair of cylinders of the engine 24*f*. In this embodiment, however, the exhaust passages extend through a portion of the engine defining the cylinders which faces towards the front (versus the rear, as in the embodiment illustrated in FIG. 15) of the watercraft 24*f*.

The exhaust pipes 40*f*,42*f* extend from the engine 24*f* towards the front of the watercraft 24*f* into the space S' and then curve up and back around the top of the engine to a single muffler or expansion pipe 45*f*. Preferably, the exhaust pipes 40*f*,42*f* are both connected to the muffler 45*f* through a flexible coupling 65*f* such as a rubber hose.

The muffler 45*f* extends beyond the rear end of the engine 24*f* towards the rear of the watercraft 24*f* to a water lock 49*f*. Preferably, the muffler 45*f* is connected to the water lock 49*f* through a flexible coupling 69*f* such as a rubber hose. A single exhaust gas discharge pipe 61*f* extends from the water lock 49*f* through the hull 22*f* to discharge the exhaust gas into the water.

This arrangement has generally the same advantages of the those of the prior embodiment, including an unrestricted exhaust gas flow, compact exhaust arrangement, equal exhaust flow path for each cylinder, and a vibration insulating muffler mounting.

Figure 20:
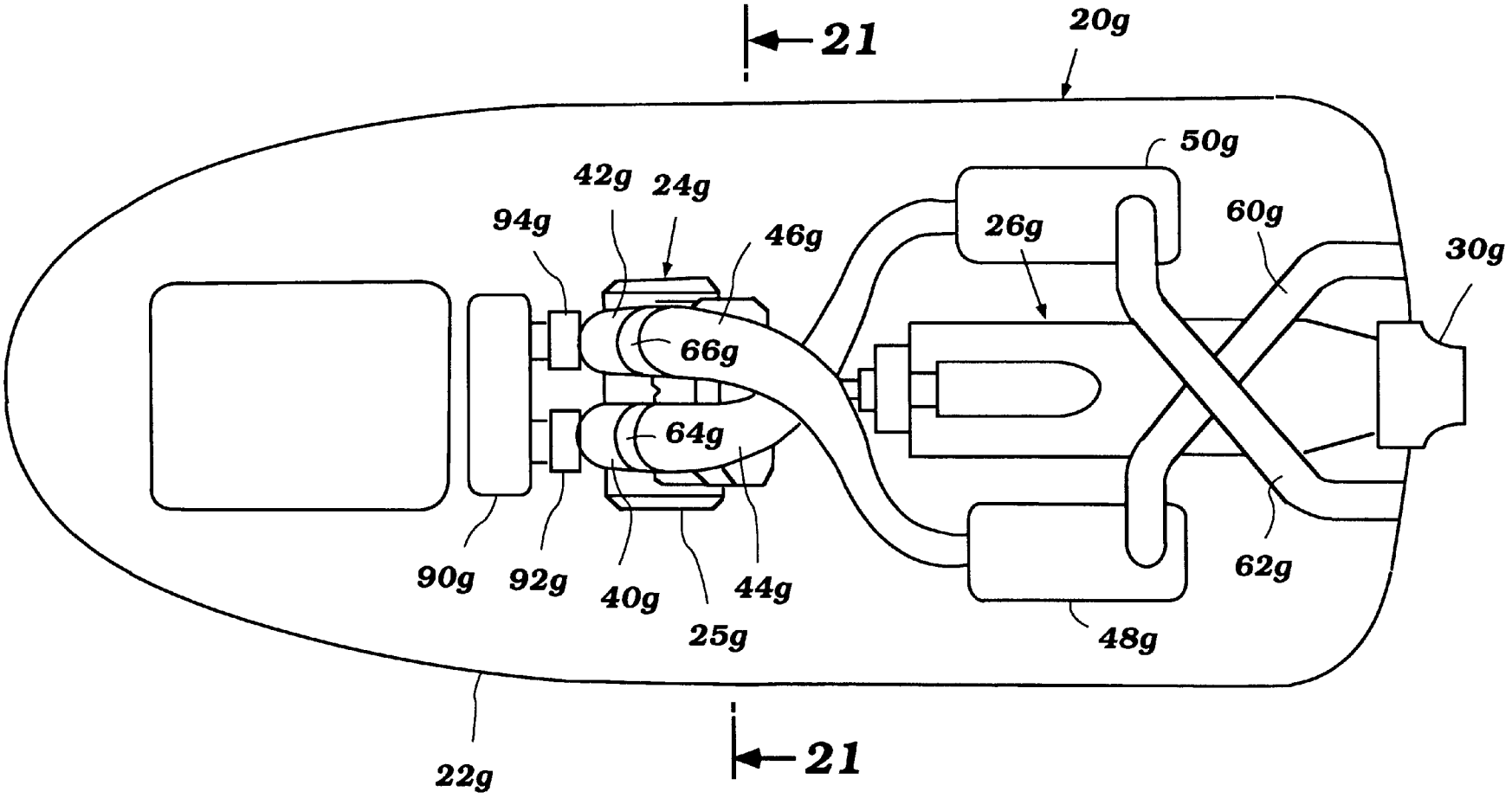
FIG. 20 is a top cross-sectional view of a watercraft powered by an engine and having an exhaust system in accordance with a eighth embodiment of the present invention.
Figure 21:
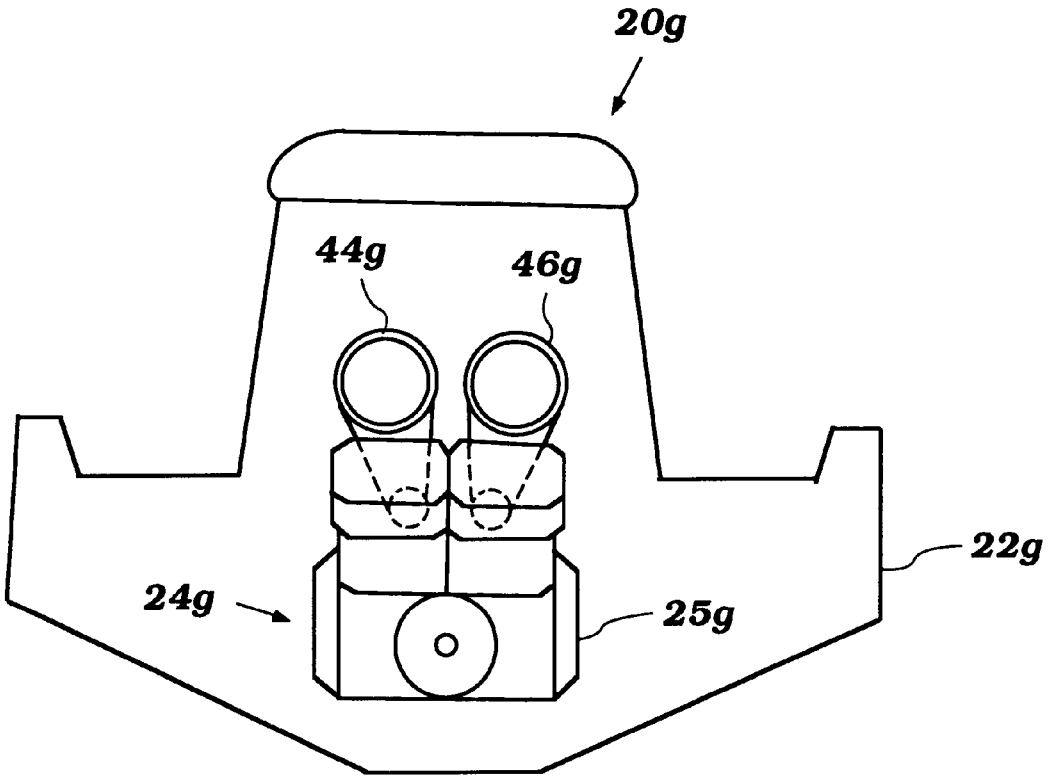
FIG. 21 is a cross-sectional view of the watercraft and exhaust system illustrated in FIG. 20 taken in the direction of line 21—21 therein.

FIGS. 20–21 illustrate a watercraft 20*g* powered by an engine 24*g* and having an exhaust system in accordance with a eighth embodiment of the present invention. In the illustration and description of this embodiment, like reference numerals have been used with similar parts to those of the prior embodiments, except that a "g" designator has been added to all reference numerals of this embodiment.

In this embodiment, the engine 24*g* is generally arranged as described and illustrated in the prior embodiment (FIGS. 17–19). The first and second exhaust pipes 40*g*,42*g* again extend outwardly from the engine 24*g* towards the front end of the watercraft 20*g* before bending upwardly over the top of the engine 24*g* to a respective muffler 44*g*,46*g*. Preferably, the exhaust pipes 40*g*,42*g* are again connected to a respective muffler 44*g*,46*g* with a flexible coupling 64*g*, 66*g*, such as a rubber hose or fitting.

As illustrated, the mufflers 44*g*,46*g* are generally elongate and extend towards the rear end of the watercraft 20*g*. The mufflers 44*g*,46*g* cross behind the engine 24*g* and lead to a water lock 48*g*,50*g*. An exhaust discharge pipe 60*g*,62*g* extends from each water lock 48*g*,50*g*, the pipes 60*g*,62*g* crossing before the extend through the hull 22*g* at the rear of the watercraft 20*g* on each side of the water propulsion device 28*g*.

This exhaust system has the advantages of those embodiments described above. This embodiment has the further advantage of providing a long exhaust path in a compact arrangement and with a generally unrestricted flow path.

Figure 22:
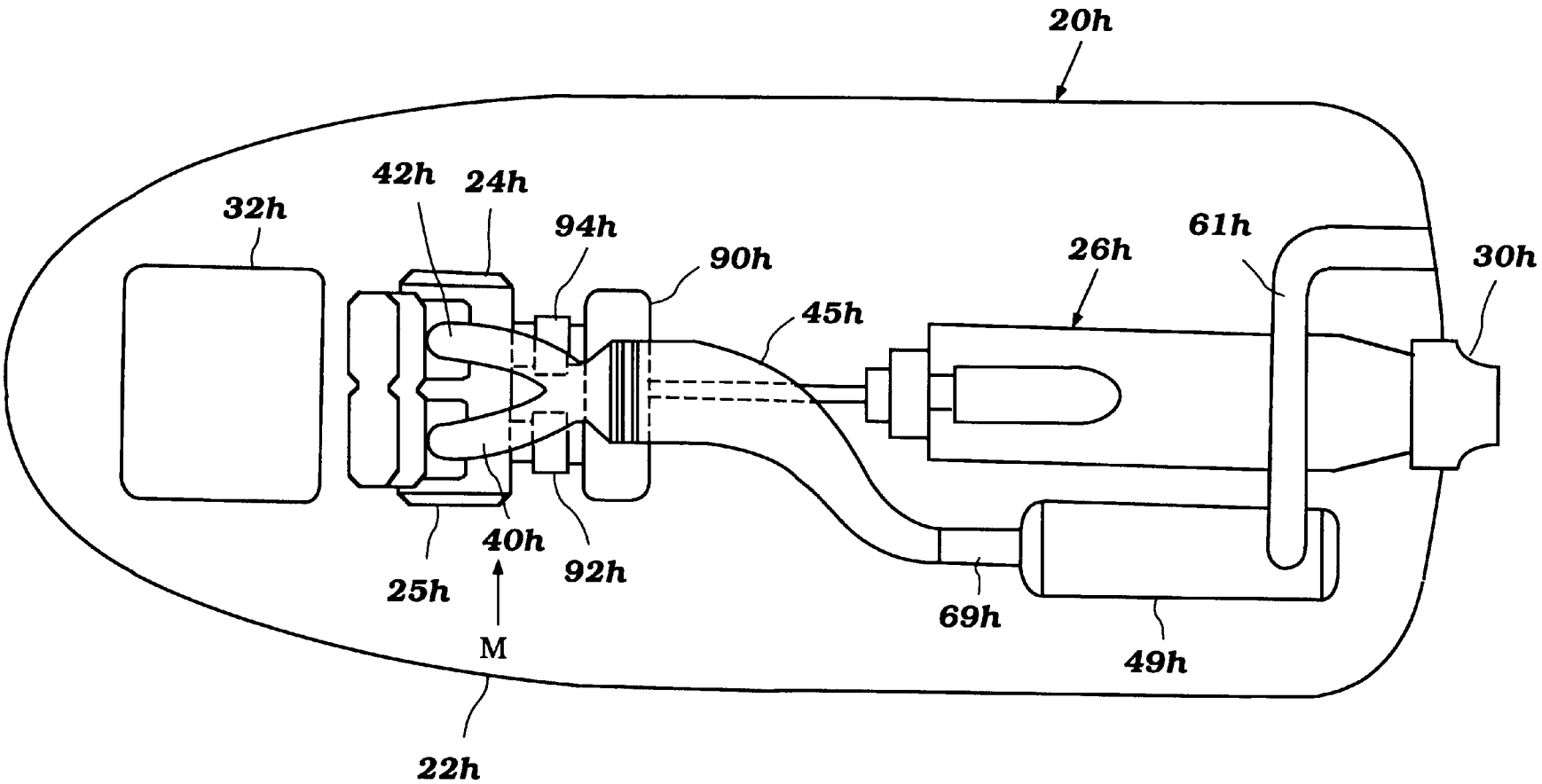
FIG. 22 is a top cross-sectional view of a watercraft powered by an engine and having an exhaust system in accordance with a ninth embodiment of the present invention.
Figure 23:
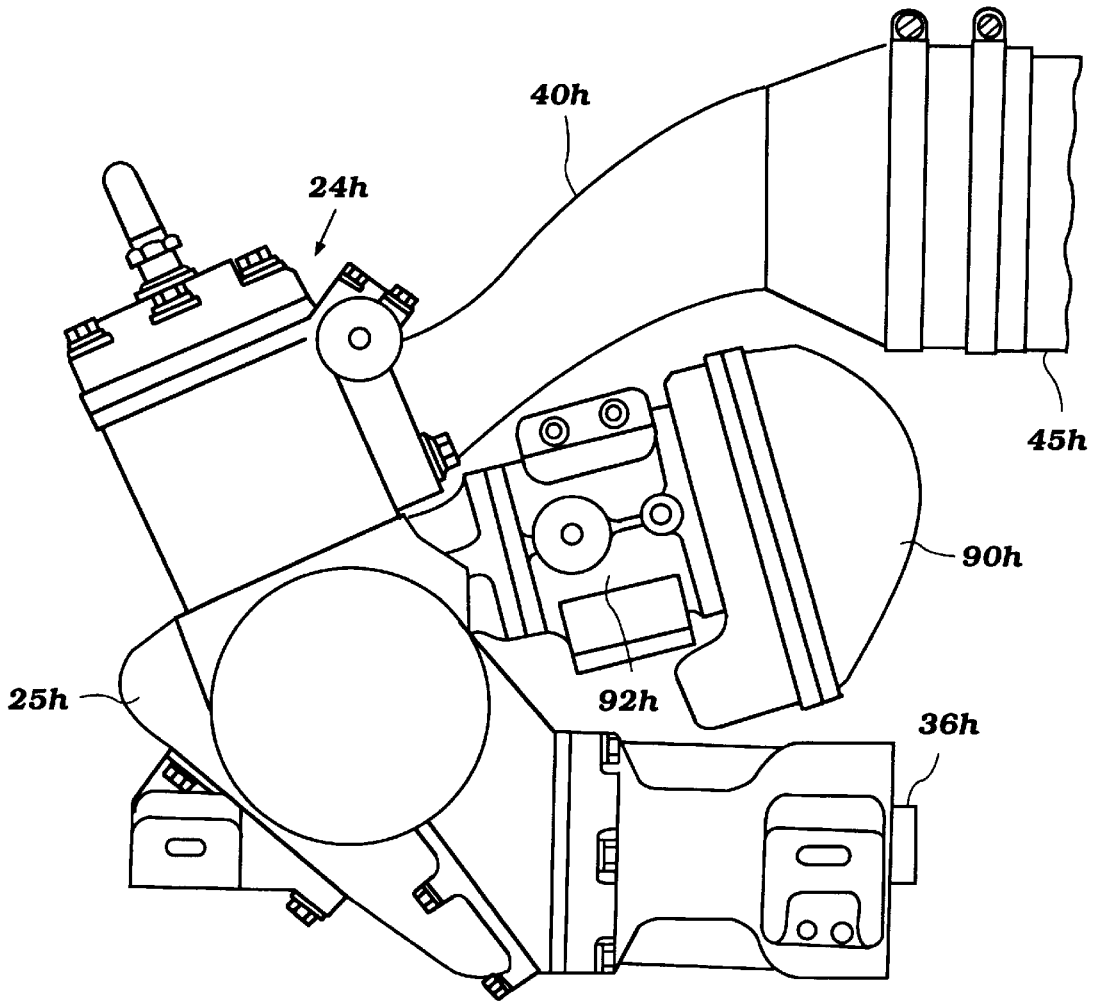
FIG. 23 is a side view of the exhaust system illustrated in FIG. 22 and taken in the direction of arrow M therein.

FIGS. 22–23 illustrate a watercraft 20*h* powered by an engine 24*h* and having an exhaust system in accordance with a ninth embodiment of the present invention. In the illustration and description of this embodiment, like reference numerals have been used with similar parts to those of the prior embodiments, except that an "h" designator has been added to all reference numerals of this embodiment.

In this embodiment, the cylinder of the engine 24*h* are again arranged in transverse fashion. The intake system is positioned at a rear end of the engine 24*h* and provides an air and fuel charge into the crankcase chamber 25*h*.

As best illustrated in FIG. 23 the exhaust passage corresponding to each cylinder extends through the engine 24*h* to its rear side. First and second exhaust pipes 40*h*,42*h* are connected to the engine 24*h* and have passages aligned with the exhaust passages leading from the cylinders. As illustrated, these exhaust pipes 40*h*,42*h* extend towards the rear of the watercraft 20*h*, merging into a single pipe portion connected to a single muffler 45*h*.

The muffler 45*h* further extends towards the rear of the watercraft 20*h* to a water lock 49*h*. The muffler 45*h* is preferably connected to the water lock 49*h* with a flexible coupling 69*h*, such as a rubber hose. A single exhaust discharge pipe 61*h* extends from the water lock 49*h* through the hull 22*h* of the watercraft 20*h* at its rear end.

This embodiment exhaust system has generally the same benefits as those described above. This arrangement has the particular benefit that the exhaust system flow path provides for unrestricted flow.

In all embodiments of the present invention, the particular connections of the various portions of the exhaust system may be arranged as known to those skilled in the art. For example, the exhaust pipes may be connected to the engine with mounting bolts or similar fasteners. The flexible coupling members may be connected to the various parts of the exhaust system with adjustable metal bands or similar fittings.

The particular materials and construction of portions of the exhaust systems described above may also be of types well known to those skilled in the art. For example, the exhaust pipes may be made of steel or the like, and the flexible coupling members may comprise rubber, flexible metal members or the like.

The term "muffler" as used above generally is meant to mean a section of the exhaust system in which the exhaust sound is reduced. This may be accomplished by a baffle-type muffler. In addition, the muffler may simply comprise an expansion chamber (i.e. a section of the exhaust system having an enlarged flow path) as known to those of skill in the art.

Of course, the foregoing description is that of preferred embodiments of the invention, and various changes and modifications may be made without departing from the spirit and scope of the invention, as defined by the appended claims.

What is claimed is:

1. A watercraft including an exhaust system for an engine powering a water propulsion device of said watercraft, said watercraft having a hull with a front end and a rear end, said water propulsion device positioned near said rear end of said watercraft, said engine connected to said hull and positioned generally towards a front end of said watercraft from said water propulsion device and having an output shaft arranged to drive said water propulsion device, said engine having at least two cylinders each of which has at least one exhaust port, and a fuel supply system including a fuel tank positioned towards said front end of said watercraft from said engine and generally at an end of said engine opposite said water propulsion device, said engine having a separate exhaust system for each of said cylinders, each of said exhaust systems defining an exhaust flow path from said engine towards said front end of said watercraft along a first side of said fuel tank and then along a second side of said fuel tank towards said rear of said watercraft to an exhaust discharge.

2. The watercraft in accordance with claim 1, further including a water lock positioned in the watercraft forwardly of the fuel tank and wherein the exhaust system flow path from the engine forwardly of the fuel tank enters the water lock device at one side thereof and the portion of the exhaust system that flows along the second side of the fuel tank flows from the water lock to the exhaust discharge.

3. A watercraft including an exhaust system for an engine powering a water propulsion device of said watercraft, said watercraft having a hull with a front end and a rear end, said water propulsion device positioned near said rear end of said watercraft, said engine connected to said hull and positioned generally towards a front end of said watercraft from said water propulsion device and having an output shaft arranged to drive said water propulsion device, said engine having a fuel supply system including a fuel tank positioned towards said front end of said watercraft from said engine and generally at an end of said engine opposite said water propulsion device, said engine having an exhaust system defining an exhaust flow path from said engine towards said front end of said watercraft along a first side of said fuel tank and then along a second side of said fuel tank towards said rear of said watercraft to an exhaust discharge, said first side of said fuel tank comprises a surface of said fuel tank facing upwardly away from said hull.

4. The watercraft in accordance with claim 2, wherein said second side of said fuel tank comprises a surface of said fuel tank facing a side of said watercraft.

5. The watercraft in accordance with claim 2, wherein said exhaust flow path is defined at least in part by a pair of exhaust pipes connected to said engine and extending therefrom, each exhaust pipe having a passage therethrough in communication with an exhaust passage through said engine defining an exhaust flow path from said engine towards said front end of said watercraft along a first side of said fuel tank and then along a second side of said fuel tank towards said rear of said watercraft to an exhaust discharge, said first side of said fuel tank comprises a surface of said fuel tank facing upwardly away from said hull.

6. The watercraft in accordance with claim 4, wherein said exhaust system includes at least one water lock positioned towards a front end of said watercraft from said fuel tank and said exhaust flow path leads through said water lock.

7. The watercraft in accordance with claim 4, wherein each exhaust pipe is connected to an expansion pipe through a flexible coupling.

8. The watercraft in accordance with claim 5, wherein there are two water locks positioned at the front end of said watercraft and forwardly of said fuel tank, and each of the exhaust pipes communicates with a respective one of the water locks.

9. The watercraft in accordance with claim 8, wherein the exhaust system flow path from the engine forwardly of the fuel tank for each of the exhaust pipes enters the respective water lock device at one side thereof and the portion of the exhaust system that flows along the second side of the fuel tank flows from the respective water lock to the respective exhaust discharge.

* * * * *